US012402663B2

(12) United States Patent
Hu et al.

(10) Patent No.: US 12,402,663 B2
(45) Date of Patent: Sep. 2, 2025

(54) ATOMIZING ASSEMBLY AND ELECTRONIC CIGARETTE

(71) Applicant: SHENZHEN FIRST UNION TECHNOLOGY CO., LTD., Shenzhen (CN)

(72) Inventors: Ruilong Hu, Shenzhen (CN); Senbing Zhao, Shenzhen (CN); Zhongli Xu, Shenzhen (CN); Yonghai Li, Shenzhen (CN)

(73) Assignee: SHENZHEN FIRST UNION TECHNOLOGY CO., LTD., Shenzhen (CN)

( * ) Notice: Subject to any disclaimer, the term of this patent is extended or adjusted under 35 U.S.C. 154(b) by 363 days.

(21) Appl. No.: 17/623,242

(22) PCT Filed: Jun. 23, 2020

(86) PCT No.: PCT/CN2020/097758
§ 371 (c)(1),
(2) Date: Dec. 27, 2021

(87) PCT Pub. No.: WO2020/259505
PCT Pub. Date: Dec. 30, 2020

(65) Prior Publication Data

US 2022/0361578 A1 Nov. 17, 2022

(30) Foreign Application Priority Data

Jun. 24, 2019 (CN) ..... 201910548306.3

(51) Int. Cl.
*A24F 40/485* (2020.01)
*A24F 40/10* (2020.01)
(Continued)

(52) U.S. Cl.
CPC ..... *A24F 40/485* (2020.01); *A24F 40/10* (2020.01); *A24F 40/42* (2020.01); *A24F 40/44* (2020.01); *A24F 40/46* (2020.01)

(58) Field of Classification Search
None
See application file for complete search history.

(56) References Cited

U.S. PATENT DOCUMENTS 9,814,269 B2 11/2017 Li et al.
2017/0156408 A1 6/2017 Li et al.
(Continued)

FOREIGN PATENT DOCUMENTS

CN 105747278 A 7/2016
CN 107951079 A 4/2018
(Continued)

*Primary Examiner* — Philip Y Louie
*Assistant Examiner* — Jeffrey A. Buckman
(74) *Attorney, Agent, or Firm* — Cheng-Ju Chiang

(57) ABSTRACT

The present invention provides an atomizing assembly and an electronic cigarette. The atomizing assembly includes a base and an atomizing core. A liquid storing cavity is disposed inside the base to store liquid tobacco. The atomizing core includes a body and a heater. An atomizing channel is opened and disposed to penetrate through the body. The heater is disposed on an inner wall of the atomizing channel. The body is made from porous materials. An outer sidewall of the body includes at least an absorbing face. A liquid conducting hole or a plurality of liquid conducting holes is opened and disposed on the absorbing face and extends into a wall of the body from the absorbing face. A contact area between the liquid tobacco and the absorbing face is large to facilitate control of an amount of conducted liquid tobacco.

12 Claims, 7 Drawing Sheets

(51) Int. Cl.

| | |
|---|---|
| ***A24F 40/42*** | (2020.01) |
| ***A24F 40/44*** | (2020.01) |
| ***A24F 40/46*** | (2020.01) |

(56) References Cited

U.S. PATENT DOCUMENTS

| | | | | |
|---|---|---|---|---|
| 2017/0215481 | A1 | 8/2017 | Li et al. | |
| 2018/0199631 | A1 | 7/2018 | Chen et al. | |
| 2019/0159524 | A1 | 5/2019 | Qiu | |
| 2020/0163381 | A1* | 5/2020 | Qiu | A24F 40/44 |
| 2020/0367564 | A1* | 11/2020 | Li | A24F 40/44 |
| 2021/0169144 | A1* | 6/2021 | Wensley | H05B 3/44 |

FOREIGN PATENT DOCUMENTS

| | | | | |
|---|---|---|---|---|
| CN | 207707306 | U | 8/2018 | |
| CN | 208096012 | U | 11/2018 | |
| CN | 109068744 | A | 12/2018 | |
| CN | 109349680 | A | 2/2019 | |
| CN | 208510082 | U | 2/2019 | |
| CN | 208550022 | U | 3/2019 | |
| CN | 110250578 | A | 9/2019 | |
| CN | 210471007 | U | 5/2020 | |
| EP | 3469928 | A1 * | 4/2019 | A24F 47/00 |
| EP | 3494811 | A1 | 6/2019 | |
| KR | 10-2019-0051787 | A | 5/2019 | |

* cited by examiner

ATOMIZING ASSEMBLY AND ELECTRONIC CIGARETTE

CROSS REFERENCE TO RELATED APPLICATIONS

The present invention is a 35 U.S.C. § 371 National Phase conversion of International (PCT) Patent Application No. PCT/CN2020/097758, filed on Jun. 23, 2020, which claims benefit of Chinese Application No. 201910548306.3, filed on Jun. 24, 2019, the disclosure of which is incorporated by reference herein. The PCT International Patent Application was filed and published in Chinese.

BACKGROUND OF THE INVENTION

Field of the Invention

The present invention relates to a technical field of electronic cigarette equipment, particularly relates to an atomizing assembly and an electronic cigarette including the atomizing assembly.

Description of Related Art

In some electronic cigarette products, an electronic cigarette includes a battery assembly and an atomization assembly. The battery assembly is electrically connected to the atomization assembly. As a result, the battery assembly supplies power to the atomization assembly.

Liquid tobacco with high viscosity has problem such that a liquid conducting process of the liquid tobacco is slow, and therefore the slow process leads to too little aerosol being generated. However, during a heating and atomization process, a viscosity of the liquid tobacco decreases. As a result, a velocity of conducting the liquid tobacco increases, and the increased conducting velocity leads to problem such as increase of an amount of conducted liquid tobacco, etc. Therefore, the liquid tobacco with high viscosity exhibits a technical problem during its heating and atomization process. The technical problem includes inconvenient control of the amount of conducted liquid tobacco, and an unreasonable amount of conducted liquid tobacco, etc. As a result, the physical feeling experienced while utilizing the products is directly affected by the above problem.

BRIEF SUMMARY OF THE INVENTION

An atomizing assembly and an electronic cigarette having the atomizing assembly are provided in accordance with a preferred embodiment of the present invention. The technical problem of existing technology, that an amount of conducted liquid tobacco is not conveniently controlled, can be solved by the utilization of the above atomizing assembly in accordance with the preferred embodiment of the present invention.

A technical solution in accordance with the preferred embodiment of the present invention is as follows.

An atomizing assembly applicable to electronic cigarettes includes a base and an atomizing core.

A liquid storing cavity is disposed inside the base to store liquid tobacco.

The atomizing core is installed in the base. The atomizing core includes a body and a heater. An atomizing channel is opened and disposed to penetrate through the body. The heater is disposed on an inner wall of the atomizing channel.

The body is made from porous materials. An outer sidewall of the body includes at least an absorbing face. A liquid conducting hole or a plurality of liquid conducting holes is opened and disposed on the absorbing face and extends into a wall of the body from the absorbing face. A bottom of the liquid conducting hole or the plurality of liquid conducting holes is located inside the wall of the body. The liquid tobacco stored in the liquid storing cavity flows into the body via the absorbing face.

Alternatively, the base is disposed along a longitudinal direction of the atomizing assembly. An extension direction of the atomizing channel is perpendicular to the longitudinal direction of the atomizing assembly.

Alternatively, an airflow channel is further disposed inside the base. The airflow channel is configured to spatially communicate with the atomizing channel.

Alternatively, the atomizing assembly further includes a nozzle shell. A through hole is disposed to penetrate through the nozzle shell. The nozzle shell is installed at a side of the base facing away from the atomizing core. The through hole is configured to spatially communicate with the atomizing channel via the airflow channel.

Alternatively, shortest conducting distances between respective bottoms of the plurality of liquid conducting holes and the inner wall of the atomizing channel are set to be equal to one another.

Alternatively, a hole diameter of each of the liquid conducting hole or the plurality of liquid conducting holes is set to be larger than an average pore diameter of micro pores inside the body.

Alternatively, the absorbing face is disposed corresponding to the liquid storing cavity. The absorbing face is a flat face. The liquid conducting hole or the plurality of liquid conducting holes is a plurality of liquid conducting holes, and the plurality of liquid conducting holes is evenly spaced and distributed on the absorbing face.

Alternatively, the base further includes a liquid filling hole and a liquid outlet.

Alternatively, the liquid filling hole is configured to spatially communicate with the liquid storing cavity. The liquid filling hole and the liquid outlet are respectively located on two opposite lateral walls of the liquid storing cavity. The liquid outlet is configured to spatially communicate with the liquid conducting hole or the plurality of liquid conducting holes.

Alternatively, the atomizing assembly further includes a supporter and an end cover.

The supporter is located at a side of the base. A fixing trough is opened and disposed at a side of the supporter facing toward the base. A part of the body is received in the fixing trough.

The end cover is disposed between the base and the supporter. Another part of the body is covered around by the end cover. The end cover is fixed connected with the supporter. The end cover is engaged with the base. A transfer hole penetrating through the end cover is opened and disposed at the end cover. The liquid outlet is configured to spatially communicate with the liquid conducting hole or the plurality of liquid conducting holes via the transfer hole.

Alternatively, a first installing trough is disposed at a side of the base facing toward the supporter. The liquid outlet is opened and disposed at a bottom of the first installing trough. The end cover is installed in the first installing trough, and the transfer hole is configured to spatially communicate with the liquid outlet.

Alternatively, the atomizing assembly further includes a connecting seat. The connecting seat is installed to the base.

A lateral wall of the connecting seat and a lateral wall of the base are fixedly connected with each other. An accommodating space is formed and surrounded between the connecting seat and the base. The atomizing core is accommodated in the accommodating space.

Alternatively, a second installing trough is disposed at a side of the connecting seat facing toward the base. The supporter is installed in the second installing trough. When the connecting seat is installed to the base, the first installing trough and the second installing trough are correspondingly disposed to match with each other in order to fixedly install the atomizing core therebetween.

An electronic cigarette in accordance with a preferred embodiment of the present invention is further provided to include the following.

An atomizing assembly mentioned above is provided.

A battery assembly is installed with the atomizing assembly and is electrically connected with the atomizing assembly.

In comparison to existing technology, in the atomizing assembly in accordance with a preferred embodiment of the present invention, a liquid conducting hole or a plurality of liquid conducting holes is opened and disposed on the absorbing face of the body. In actual products, liquid conducting holes with various forms can be disposed and opened on a lateral wall of the body based on user's requirement in order to much conveniently control a liquid conducting process of liquid tobacco. Besides, liquid tobacco enters the body through the absorbing face. A contact area between the liquid tobacco and the absorbing face is large to facilitate control of an amount of conducted liquid tobacco.

BRIEF DESCRIPTION OF THE DRAWINGS

In order to much explicitly describe technical solutions in accordance with a preferred embodiment of the present invention, the following will briefly introduce attached drawings required to be used in descriptions of the preferred embodiment of the present invention. Obviously, the attached drawings in the following descriptions show only some embodiments of the present invention. For those of ordinary skill in the art, other attached drawings can be further obtained based on structures shown in these attached drawings without any creative labor or work.

DETAILED DESCRIPTION OF THE INVENTION

In order to facilitate best understanding of the present invention, the present invention will be illustrated in more detail below in conjunction with the attached drawings and preferred embodiments. It should be noted that when an element is expressed as "being fixed to/being fixedly connected to" another element, this element may be directly on the another element, or there may be one or more intervening elements between this element and the another element. When an element is expressed as "being connected to" another element, this element can be directly connected to the another element, or there may be one or more intervening elements between this element and the another element. Terminology in the specification such as "vertical", "horizontal", "left", "right", "inside", "outside", or similar expressions, etc., is only used for descriptive purposes.

Unless otherwise defined, any technical and scientific terminology used in this specification has the same meaning as commonly understood by those skilled in the technical field of the present invention. Terminology used in this specification of the present invention is only for a purpose of describing specific embodiments, and is not used to limit the present invention. Terminology such as "and/or" used in this specification includes any and all combinations of one or more related listed items.

In addition, technical features involved in different embodiments of the present invention described below can be mutually combined as long as they do not conflict with one another.

In this specification, the term of "installation" means to include methods, such as welding, screwing, clamping, bonding, etc., in order to fix or restrict a certain element or device to a specific position or place. The element or device can be held still in a specific position or place, or can be restricted to move within a limited range. The element or device can be disassembled or cannot be disassembled after being fixed or restricted to a specific position or place. The above is not limited in embodiments of the present application.

Figure 1:
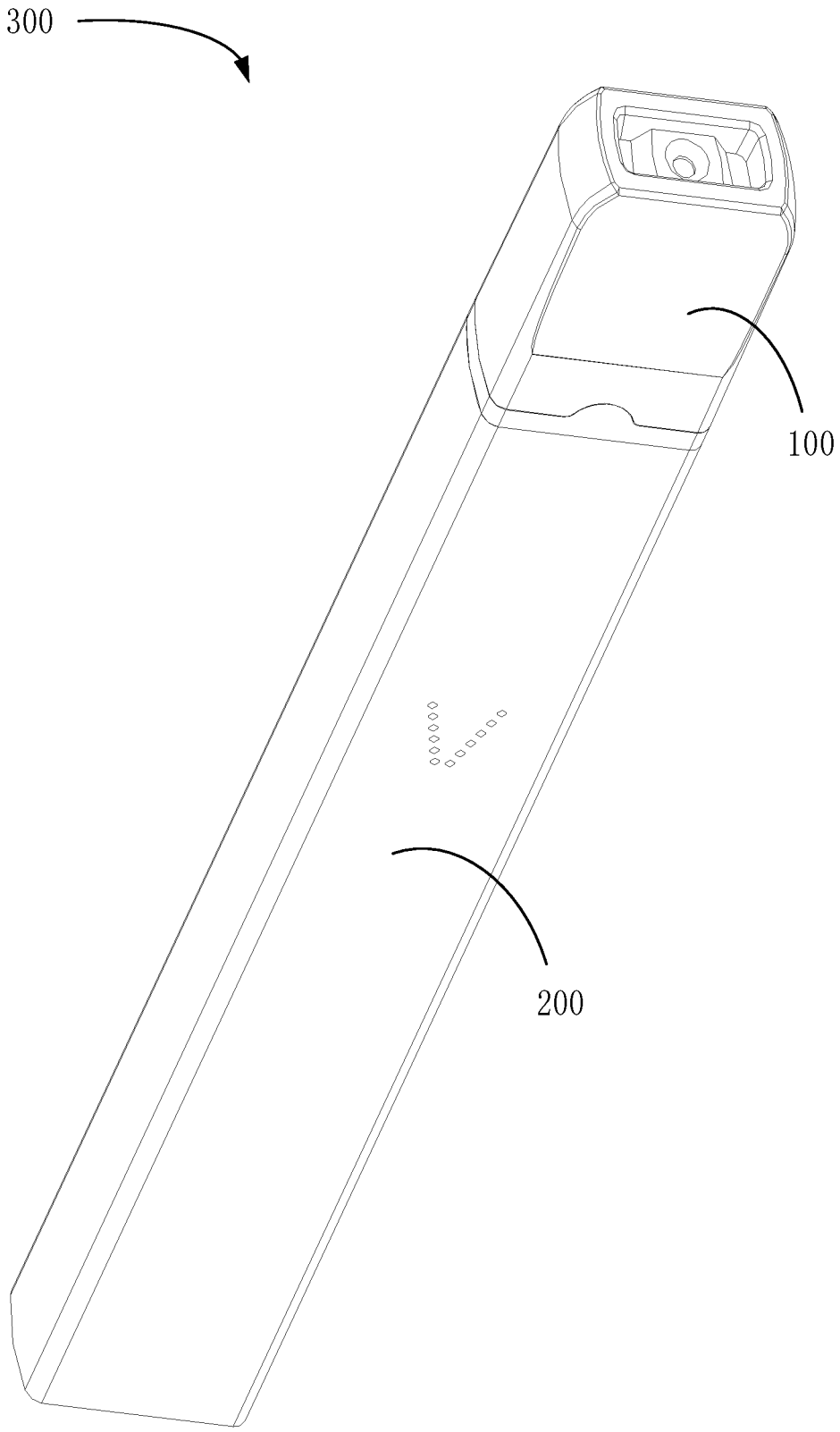
FIG. 1 shows a schematic perspective view of an electronic cigarette in accordance with a preferred embodiment of the present invention.

Referring to FIG. 1, an electronic cigarette 300 in accordance with a preferred embodiment of the present invention is provided. The electronic cigarette 300 includes a battery assembly 200 and an atomizing assembly 100. The battery assembly 200 is installed at an end of the atomizing assembly 100 in order to shape the electronic cigarette 300 as a straight-lined structure. Alternatively, the battery assembly 200 and the atomizing assembly 100 are fixedly installed together via engaging connection and/or screw fixing connection.

Understandably, the battery assembly 200 is electrically connected with the atomizing assembly 100. The battery assembly 200 is used to supply power to the atomizing assembly 100 so that the atomizing assembly 100 is able to atomize liquid tobacco into aerosols for users to inhale.

Figure 2:
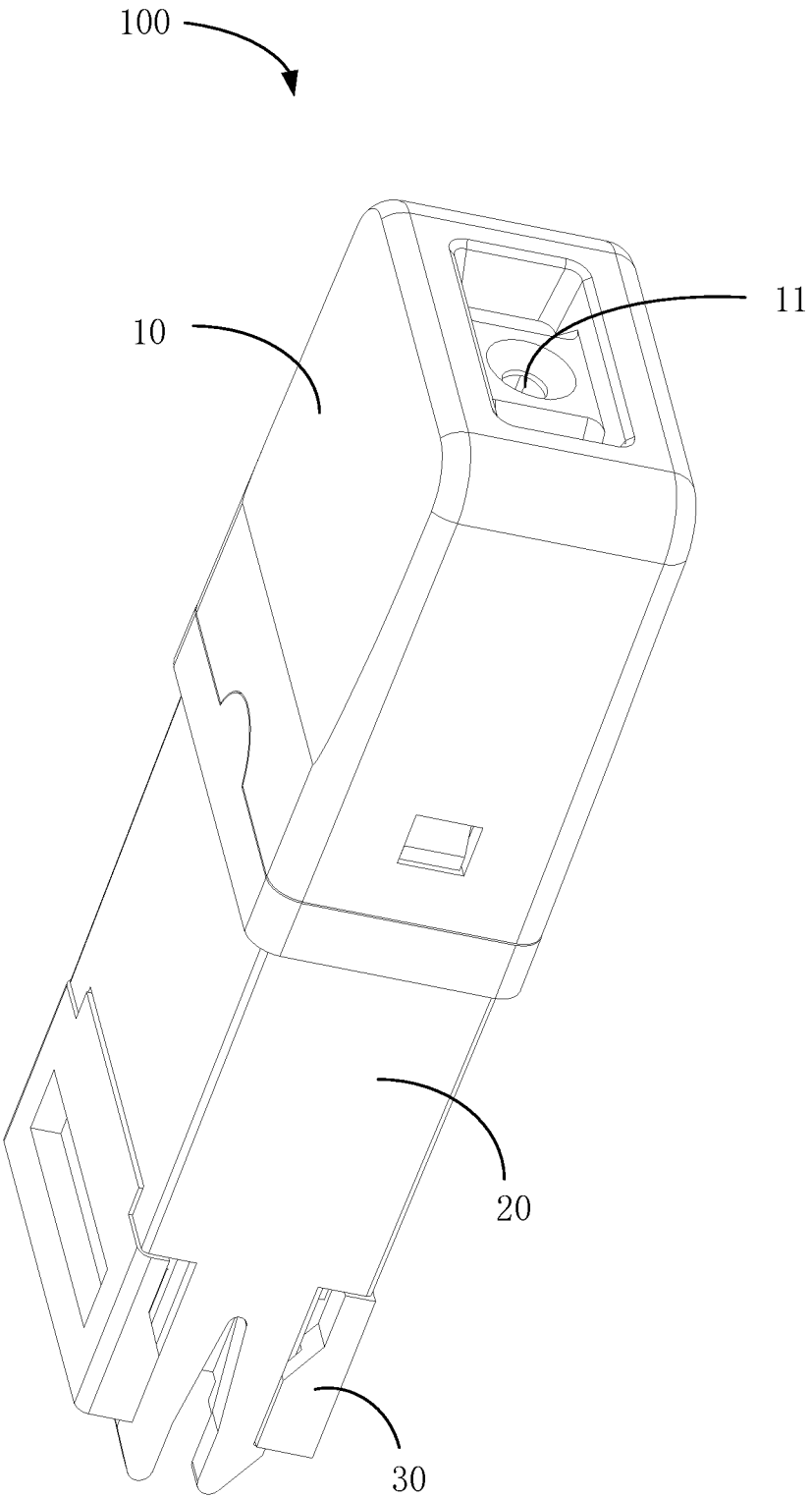
FIG. 2 shows a schematic perspective view of an atomizing assembly shown in FIG. 1 in accordance with a preferred embodiment of the present invention.
Figure 3:
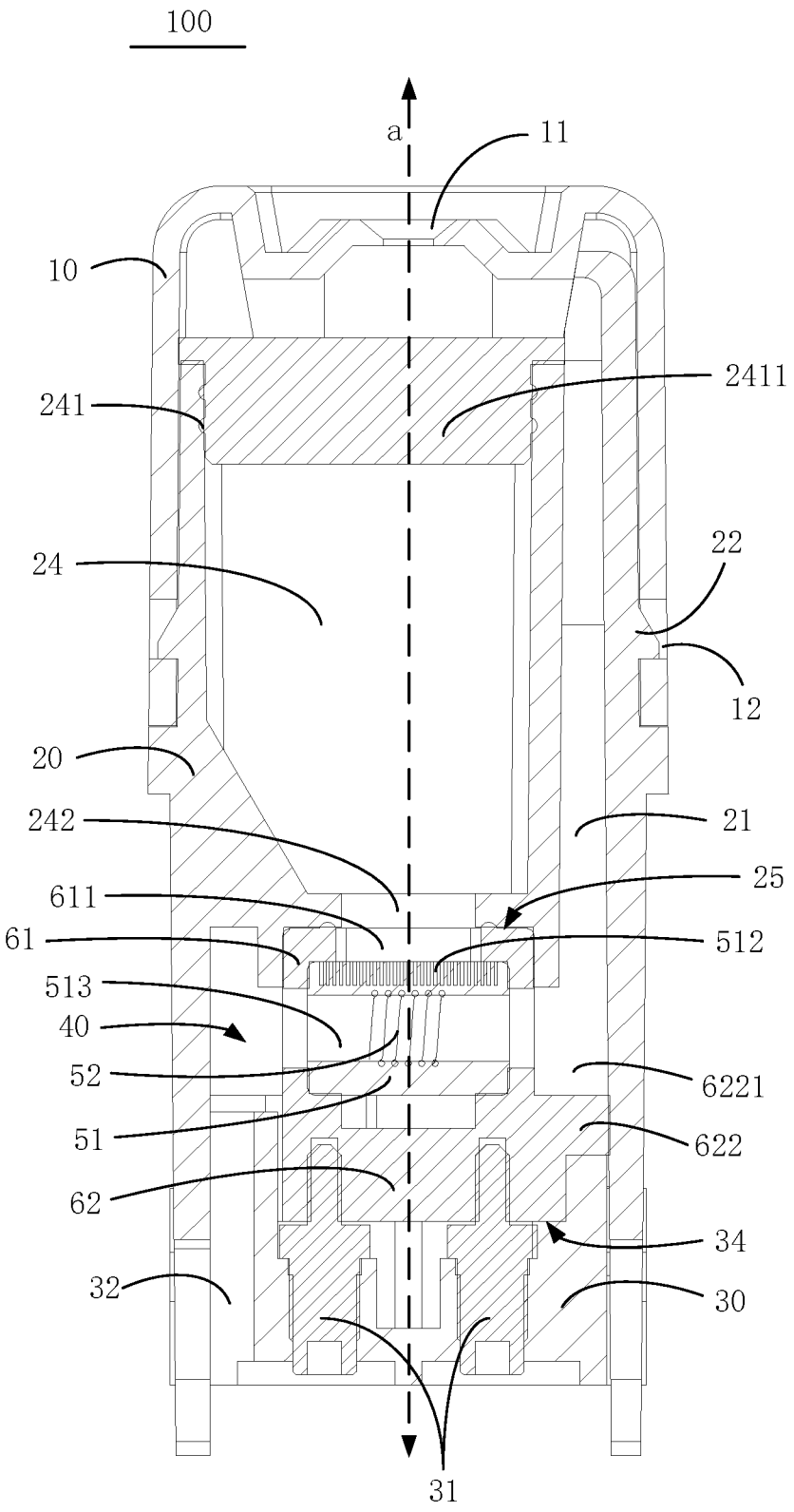
FIG. 3 shows a schematic cross sectional view of the atomizing assembly shown in FIG. 2 in accordance with a preferred embodiment of the present invention.

Referring to FIGS. 2-3, the atomizing assembly 100 includes a nozzle shell 10, a base 20 and a connecting seat 30. The nozzle shell 10, the base 20 and the connecting seat 30 are fixedly connected in sequence to form a straight-lined structure. The nozzle shell 10, the base 20 and the connecting seat 30 are all disposed along a longitudinal direction a of the atomizing assembly 100. The battery assembly 200 is installed at an end of the connecting seat 30 spaced away from the base 20.

The nozzle shell 10 is shaped as a cover. The base 20 is substantially shaped as a hexahedron. The nozzle shell 10 covers around outside an end of the base 20. A through hole 11 is disposed to penetrate through a top of the nozzle shell 10. An airflow channel 21 is disposed inside the base 20 or at a lateral side of the base 20. When the nozzle shell 10 covers around outside the end of the base 20, the through hole 11 is configured to spatially communicate with the airflow channel 21. Alternatively, the airflow channel 21 is straightly disposed along a lateral wall of the base 20. The airflow channel 21 extends along a direction parallel to the longitudinal direction a of the atomizing assembly 100.

In a preferred embodiment of the present invention, a protrusion 22 is disposed to protrude at a lateral side of the base 20. An engaging notch 12 is disposed at a lateral side of the nozzle shell 10 corresponding to the protrusion 22. When the nozzle shell 10 covers around on a top of the base 20, the protrusion 22 is engaged and mated with the engaging notch 12 in order to fixedly install the nozzle shell 10 onto the end of the base 20, and to therefore spatially communicate the through hole 11 with the airflow channel 21.

A liquid storing cavity 24 is disposed inside the base 20. A liquid filling hole 241 is disposed to be opened at the top of the base 20 and is configured to spatially communicate with the liquid storing cavity 24. Alternatively, the liquid filling hole 241 is located in a position corresponding to the through hole 11. Understandably, the atomizing assembly 100 further includes a seal 2411. The seal 2411 is used to seal and block the liquid filling hole 241. When the nozzle shell 10 is opened and removed by a user, the seal 2411 can be seen by the user. After the seal 2411 is opened and removed by the user, liquid tobacco can be filled into the liquid storing cavity 24 via the liquid filling hole 241.

A liquid outlet 242 is disposed to be opened at a bottom of the base 20 and to be configured to spatially communicate with the liquid storing cavity 24. The liquid outlet 242 is used to conduct liquid tobacco in the liquid storing cavity 24 out of the liquid storing cavity 24. The liquid outlet 242 and the liquid filling hole 241 are respectively located on two opposite lateral walls of the liquid storing cavity 24.

Figure 4:
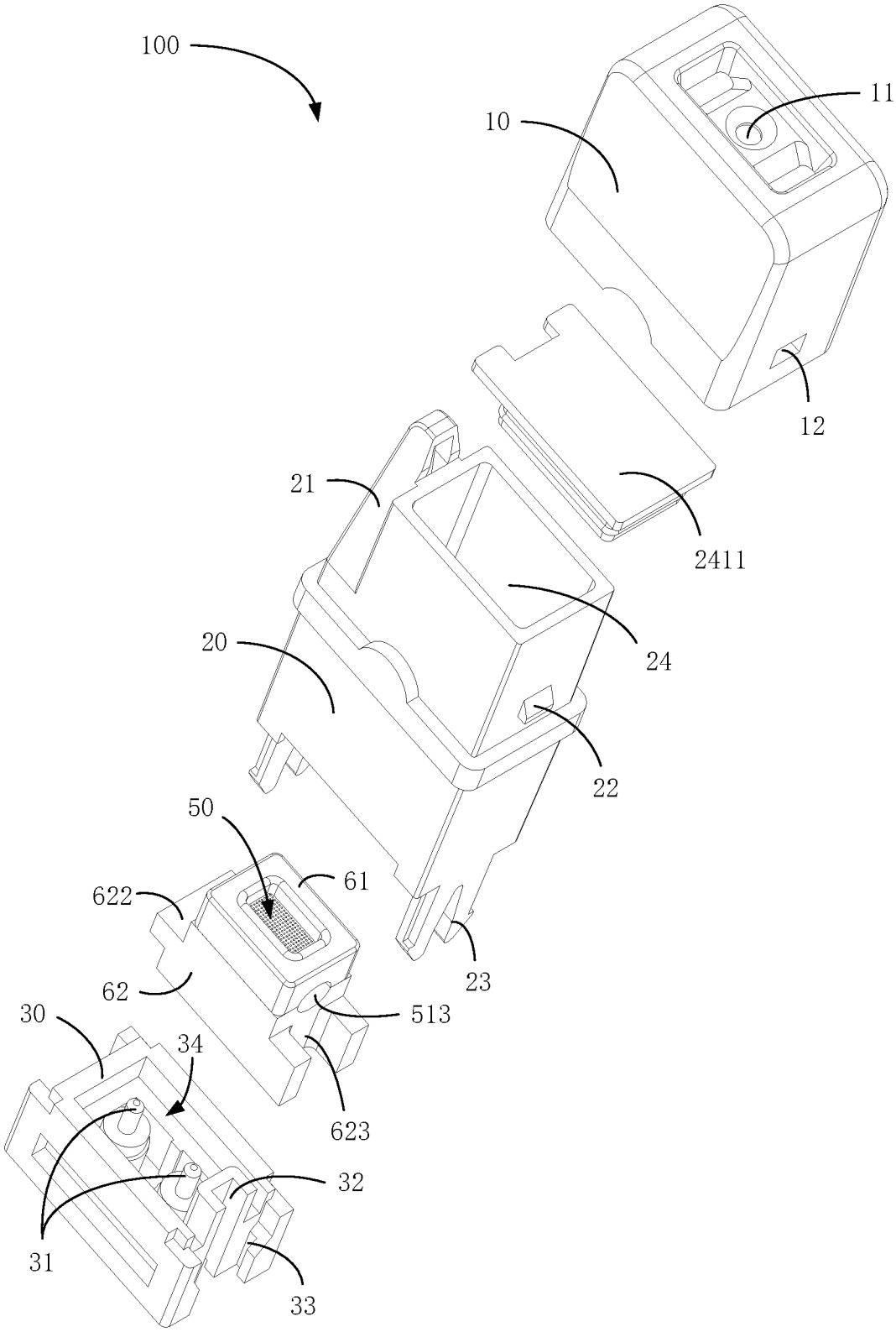
FIG. 4 shows a schematic exploded perspective view of the atomizing assembly shown in FIG. 2.
Figure 5:
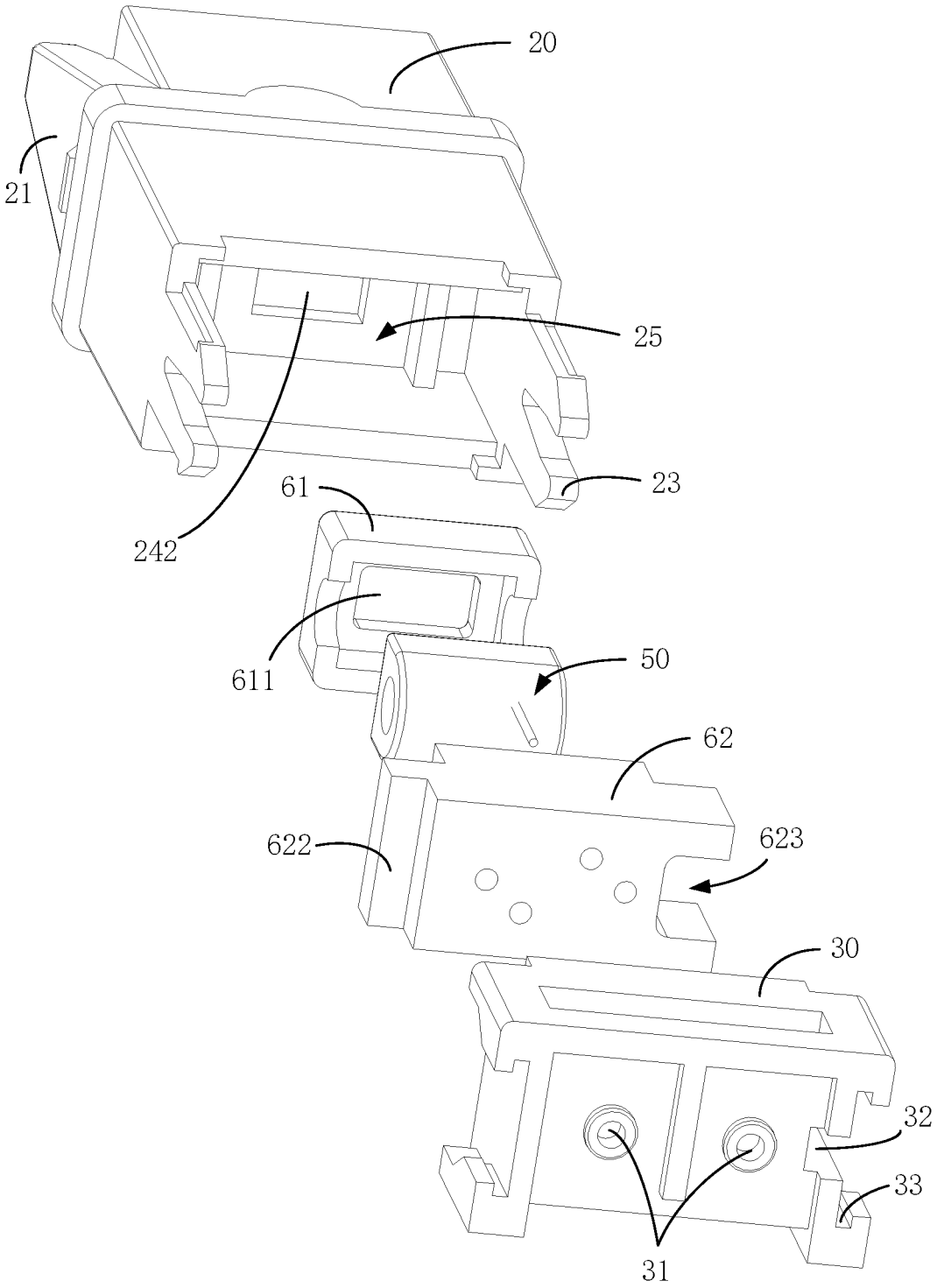
FIG. 5 shows a schematic exploded perspective view of the atomizing assembly shown in FIG. 4 viewed from another view angle by omitting a nozzle shell and a seal.
Figure 6:
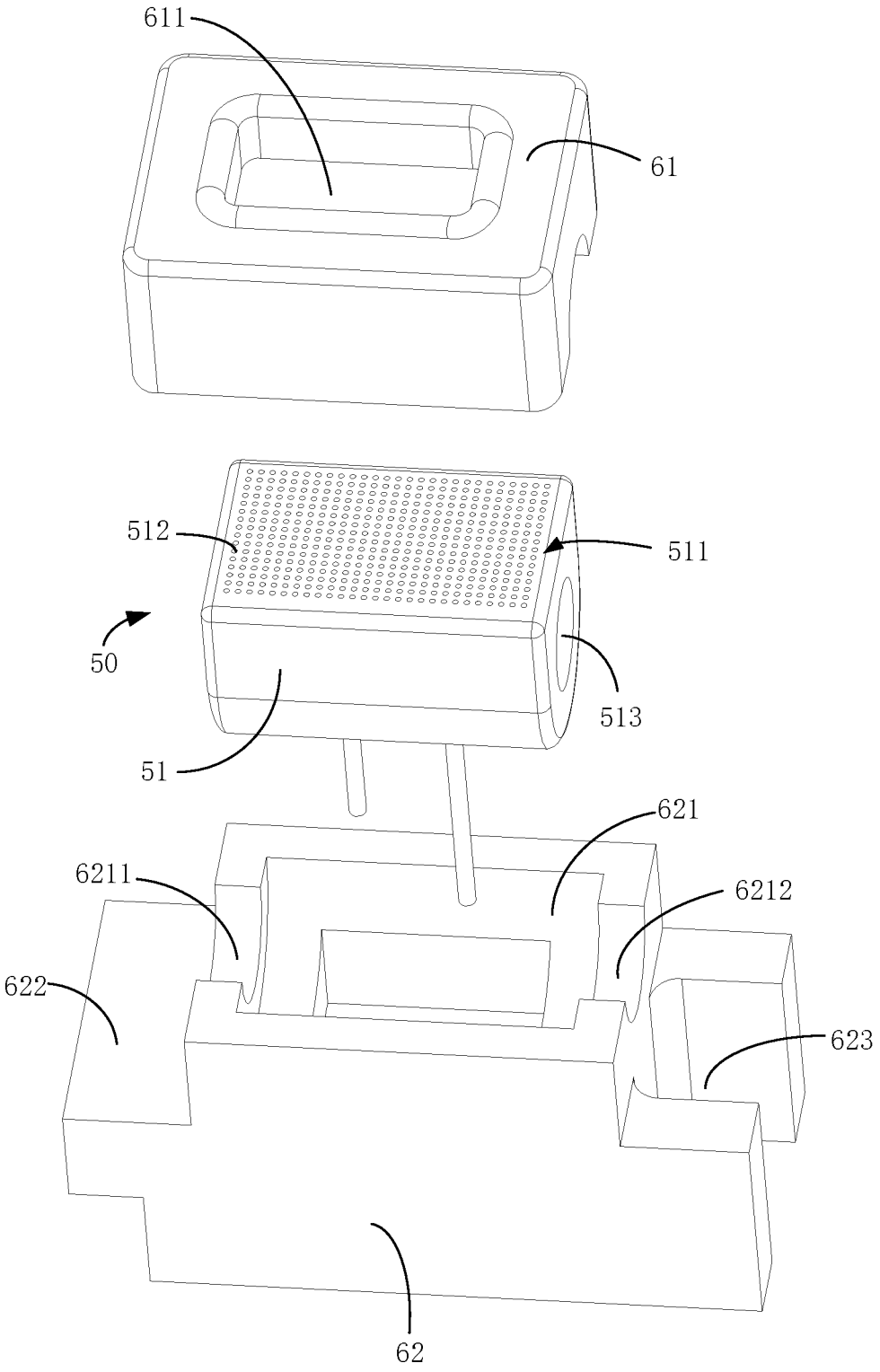
FIG. 6 shows a schematic exploded perspective view of an atomizing core of FIG. 4 showing installation thereof.

Referring to FIGS. 4-6, the connecting seat 30 is installed at the bottom of the base 20. Alternatively, the connecting seat 30 and the base 20 are connected to each other via an engaging fixing connection. A lateral wall of the base 20 and a lateral wall of the connecting seat 30 are engaged and fixedly connected with each other. An accommodating space 40 (As shown in FIG. 3) is surrounded between the base 20 and the connecting seat 30. In a preferred embodiment of the present invention, a hook or a plurality of hooks 23 is formed to extend from a side of a lateral wall of the base 20 facing toward the connecting seat 30. A groove or a plurality of groove 33 is disposed to be opened at a lateral wall of the connecting seat 30 corresponding to the hook or the plurality of hooks 23. The hook or the plurality of hooks 23 and the groove or the plurality of groove 33 are one-to-one corresponded to and mated with each other. The hook or the plurality of hooks 23 is inserted into the groove or the plurality of groove 33 correspondingly to be secured and fixed therein.

The atomizing assembly 100 further includes an atomizing core 50, an end cover 61 and a supporter 62. The atomizing core 50 is accommodated in the accommodating space 40. The atomizing core 50 includes a body 51. The body 51 is installed on the supporter 62. The end cover 61 is disposed around the body 51 and is fixedly connected with the supporter 62 in order to seal and fix the body 51. In some embodiments of the present invention, a connection between the end cover 61 and the supporter 62 can be an integrally formed connection, a fixedly engaging connection, or a screw fixing connection, etc.

In a preferred embodiment of the present invention, a first installing trough 25 is disposed at a side of the bottom of the base 20 facing toward the connecting seat 30. A second installing trough 34 is disposed at a side of the connecting seat 30 facing toward the base 20. The first installing trough 25 and the second installing trough are correspondingly disposed to match with each other in order to fixedly install the atomizing core 50 therebetween. In particular, a top of the end cover 61 is shaped similarly to the first installing trough 25, and the top of the end cover 61 is sealed and installed in the first installing trough 25. A bottom of the supporter 62 is shaped similarly to the second installing trough 34, and the bottom of the supporter 62 is installed in the second installing trough 34. When the base 20 and the connecting seat 30 are engaged and fixed together, the atomizing core 50 is fixedly engaged therebetween.

The liquid outlet 242 is opened and disposed at a bottom of the first installing trough 25. A transfer hole 611 penetrating through the end cover 61 is opened and disposed at an end of the end cover 61 neighboring the liquid outlet 242, and the transfer hole 611 is configured to spatially communicate with the liquid outlet 242. In a preferred embodiment of the present invention, the transfer hole 611 is opened and disposed at the top of the end cover 61. Liquid tobacco in the liquid storing cavity 24 can flow in sequence through the liquid outlet 242 and the transfer hole 611 to enter the body 51.

Figure 7:
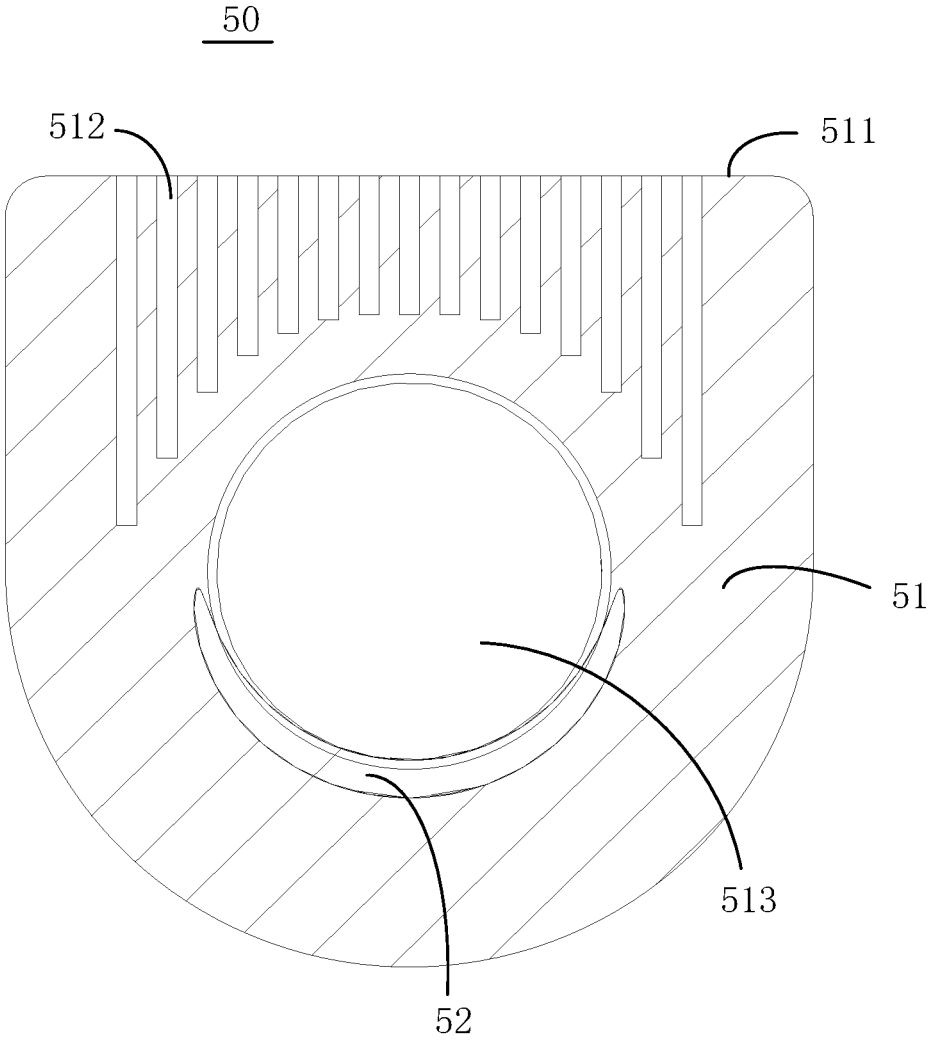
FIG. 7 shows a schematic cross sectional view of the atomizing core shown in FIG. 6.

Referring to FIGS. 6-7, an atomizing channel 513 is opened and disposed to penetrate through the body 51. The atomizing channel 513 extends horizontally. Alternatively, the atomizing channel 513 is shaped as a straight line. Furthermore, the atomizing channel 513 is shaped as a cylinder. The atomizing core 50 further includes a heater 52 disposed in the atomizing channel 513. For example, the heater 52 is disposed on an inner wall of the atomizing channel 513. In some embodiments of the present invention, the heater 52 is coiled around on the inner wall of the atomizing channel 513, is embedded in the inner wall of the atomizing channel 513, or is partially embedded in the inner wall of the atomizing channel 513 and partially exposed out in the atomizing channel 513. Understandably, the heater 52 is an electrically powered heating body. In a condition of electrification, the heater 52 is heated to raise its temperature. For example, the heater 52 is an electric heating wire.

In a preferred embodiment of the present invention, the body 51 is made from a porous material having a micro-pore structure. For example, the body 51 is made from micro-pore ceramic, micro-pore glass or expanded foam materials, etc. Liquid tobacco is conducted to the atomizing channel 513 through porous material via capillary effect. Under heating of the heater 52 to raise its temperature, the liquid tobacco is atomized as aerosols to enter the atomizing channel 513.

An outer sidewall of the body 51 includes at least an absorbing face 511. In a preferred embodiment of the present invention, the absorbing face 511 is a flat face. The absorbing face 511 is disposed corresponding to the liquid storing cavity 24, and faces toward the transfer hole 611. A liquid conducting hole or a plurality of liquid conducting holes 512 is opened and disposed on the absorbing face 511, and extends into a wall of the body 51 from the absorbing face 511. A bottom of the liquid conducting hole or the plurality of liquid conducting holes 512 is located inside the wall of the body 51. For instance, a plurality of liquid conducting holes 512 is provided and disposed, and is evenly spaced and distributed on the absorbing face 511. Furthermore, shortest conducting distances between bottoms of the plurality of liquid conducting holes 512 and the atomizing channel 513 are respectively set to be equal or substantially equal to one another. The plurality of liquid conducting holes 512 is used to conduct liquid tobacco in the liquid storing cavity 24 into the body 51. In a preferred embodiment of the present invention, when the body 51 is transversely disposed, an extension direction of the atomizing channel 513 is perpendicular to the longitudinal direction a of the atomizing assembly 100. In other words, the absorbing face 511 opened and disposed with the liquid conducting hole or the plurality of liquid conducting holes 512 has a large area, i.e., a contact area for the liquid tobacco to enter the atomizing core 50 is large. Conducted liquid tobacco is facilitated to be controlled by the above mentioned structure.

In a preferred embodiment of the present invention, liquid tobacco in the liquid storing cavity 24 flows in sequence through the liquid outlet 242, the transfer hole 611 and the liquid conducting hole or a plurality of liquid conducting holes 512 to enter the body 51. Under heating of the heater 52 to raise its temperature, the liquid tobacco is heated and atomized into aerosols to enter the atomizing channel 513.

In a preferred embodiment of the present invention, the body 51 is made from porous materials having a preset porosity. Porosity of a porous material is decided by pore diameters of micro pores inside the porous material and a distribution density of the micro pores. When the porosity of the porous material is designed to be smaller, performance of the body 51 to prevent liquid tobacco from leaking can therefore be enhanced. However, smaller porosity will lower a conducting velocity of liquid tobacco at the same time. Hence, in physical products, a porous material with a proper porosity is required to be selected. For liquid tobacco with a higher viscosity, the liquid conducting hole or the plurality of liquid conducting holes 512 is opened and disposed on the body 51, and a hole diameter of the liquid conducting hole or the plurality of liquid conducting holes 512 is set to be larger than an average pore diameter of micro pores inside a material of the body 51. As a result, the conducting velocity of the liquid tobacco can be raised, and the performance of the body 51 enough to prevent the liquid tobacco from leaking can also be ensured to be enhanced. As a practical solution, the average pore diameter of the micro pores inside the material of the body 51 is 10 μm~100 μm, for example, preferably is 80 μm. The hole diameter of the liquid conducting hole or the plurality of liquid conducting holes 512 is 10 μm~500 μm, for example, preferably is 100 μm. When the hole diameter of the liquid conducting hole or the plurality of liquid conducting holes 512 is larger than the average pore diameter of the micro pores inside the body 51, and a viscosity of liquid tobacco is higher, the liquid tobacco can enter the liquid conducting hole or the plurality of liquid conducting holes 512 having a larger hole diameter in order to have the liquid tobacco being conducted smoothly. After the liquid tobacco is heated to raise its temperature, the viscosity of the liquid tobacco is reduced. At this moment, the liquid tobacco enters the micro pores inside the body 51 having a smaller pore diameter. Hence, an amount of conducted liquid tobacco can be effectively controlled. The liquid tobacco is finally atomized by the heater 52 into aerosols to enter the atomizing channel 513. The body 51 of a preferred embodiment of the present invention is designed to have a better performance to conduct liquid tobacco into the body 41. Particularly, for tobacco liquid with a higher viscosity, the body 51 of the present invention has a better liquid conductive effect. Meanwhile, the body 51 of the present invention can achieve a better control on conducting liquid tobacco so as to avoid technical problem of having an excessively large amount of conducted liquid tobacco during a process of heating and atomizing.

A fixing trough 621 is opened and disposed at a top of the supporter 62. The body 51 is transversely installed in the fixing trough 621. In other words, the body 51 is transversely installed in the fixing trough 621 and a channel extension direction of the atomizing channel 513 is perpendicular to the longitudinal direction a of the atomizing assembly 100. A first opening 6211 is disposed at an end of the fixing trough 621, and a second opening 6212 is disposed at another end of the fixing trough 621. The first opening 6211 is disposed corresponding to an end opening of the atomizing channel 513. The second opening 6212 is disposed corresponding to another end opening of the atomizing channel 513. The supporter 62 includes an extending wall 622 formed by extending outwards from an end of the supporter 62 having the first opening 6211. When the bottom of the supporter 62 is installed in the second installing trough 34, the extending wall 622 is engaged at a lateral wall of the second installing trough 34. Besides, a connective trough 6221 (Shown in FIG. 3) is formed and surrounded by the extending wall 622 and the base 20. Two ends of the connective trough 6221 are respectively configured to spatially communicate with the airflow channel 21 and the first opening 6211. In other words, the airflow channel 21, the connective trough 6221, the first opening 6211, the atomizing channel 513 and the second opening 6212 are configured to spatially communicate with one another in sequence.

Referring to FIGS. 5-6, a first airflow trough 623 is formed by extending outwards from an end of the supporter 62 having the second opening 6212. The first airflow trough 623 is configured to spatially communicate with the second opening 6212. A second airflow trough 32 is disposed in the connecting seat 30. The second airflow trough 32 is configured to spatially communicate with the first airflow trough 623. Alternatively, the second airflow trough 32 penetrates through the connecting seat 30. The second airflow trough 32 is shaped as a straight line, and an extending direction of the second airflow trough 32 is parallel to the longitudinal direction a of the atomizing assembly 100. In a preferred embodiment of the present invention, the second airflow trough 32 and the first airflow trough 623 are located at a same side of the atomizing assembly 100. The through hole 11, the airflow channel 21, the connective trough 6221, the first opening 6211, the atomizing channel 513, the second opening 6212, the first airflow trough 623 and the second airflow trough 32 are configured to spatially communicate with one another in sequence. Aerosols formed and existing in the atomizing channel 513 can therefore be inhaled by users via the through hole 11.

Understandably, electrodes 31 are disposed at the connecting seat 30. The battery assembly 200 is located at an end of the connecting seat 30 spaced away from the base 20. When the connecting seat 30 is fixedly connected with the base 20, the battery assembly 200 is electrically connected with the heater 52 via the electrodes 31 in order to supply power to the atomizing assembly 100 so that the atomizing assembly 100 is able to atomize liquid tobacco. In a preferred embodiment of the present invention, two electrodes 31 are disposed at the connecting seat 30. An end of each of the electrodes 31 is electrically connected with the heater 52, and another end of the each of the electrodes 31 is electrically connected with the battery assembly 200.

To sum up, a technical solution of the present invention includes, but is not limited to include, the following advantages.

In the atomizing assembly 100 in accordance with a preferred embodiment of the present invention, a liquid conducting hole or a plurality of liquid conducting holes 512 is opened and disposed on the absorbing face 511 of the body 51. In actual products, liquid conducting holes 512 with various forms can be disposed and opened on a lateral wall of the body 51 based on user's requirement in order to much conveniently control a liquid conducting process of liquid tobacco. When the body 51 is transversely disposed, an extension direction of the atomizing channel 513 is perpendicular to the longitudinal direction a of the atomizing assembly 100. Liquid tobacco enters the atomizing core 50 through the absorbing face 511. A contact area between the liquid tobacco and the absorbing face is large to facilitate control of an amount of conducted liquid tobacco.

Finally, it should be noted that the above embodiments are only used to illustrate technical solutions of the present invention, but not to limit them. Under inventive ideas of the present invention, technical features of the above embodiments or different embodiments can also be combined. Steps can be implemented in any order, and there are many other variations in different aspects of the present invention as described above. For the sake of brevity, those variations are not provided in details. Although the present invention has been described in detail with reference to the foregoing embodiments, it should be understood by the ordinary skilled in the art that they can still modify technical solutions recorded in the foregoing embodiments, or equivalently replace some of the technical features. Besides, these modifications or substitutions do not make essence of corresponding technical solutions deviate from the scope of the technical solutions provided in all preferred embodiments of the present invention.

What is claimed is:

1. An atomizing assembly applicable to electronic cigarettes comprising a base and an atomizing core; wherein a liquid storing cavity is disposed inside the base to store liquid tobacco;

the atomizing core is installed in the base, the atomizing core comprises a body and a heater, a cylindrical atomizing channel is disposed through the body, the heater is disposed on an inner wall of the atomizing channel;

the body is made from porous materials, an outer sidewall of the body comprises at least a flat absorbing face facing normally toward the liquid storing cavity, a central line of the absorbing face extends parallel to an extending direction of the atomizing channel, a plurality of liquid conducting holes is opened and disposed on the absorbing face and extends into a wall of the body from the absorbing face toward the inner wall of the atomizing channel, a bottom of each of the plurality of liquid conducting holes is located inside the wall of the body, the liquid tobacco stored in the liquid storing cavity flows into the body via the absorbing face;

shortest conducting distances between respective bottoms of the plurality of liquid conducting holes and the inner wall of the atomizing channel are set to be equal, and an extension length of at least one of the plurality liquid conducting holes closer to the central line of the absorbing face is shorter than extension lengths of others of the plurality liquid conducting holes located farther away from the central line of the absorbing face.

2. The atomizing assembly as claimed in claim 1, wherein the base is disposed along a longitudinal direction of the atomizing assembly, and the atomizing channel extends perpendicularly to the longitudinal direction of the atomizing assembly.

3. The atomizing assembly as claimed in claim 1, wherein an airflow channel is further disposed inside the base, the airflow channel is configured to spatially communicate with the atomizing channel.

4. The atomizing assembly as claimed in claim 3, wherein the atomizing assembly further comprises a nozzle shell, a through hole is disposed to penetrate through the nozzle shell, the nozzle shell is installed to the base, the through hole is configured to spatially communicate with the atomizing channel via the airflow channel.

5. The atomizing assembly as claimed in claim 1, wherein a hole diameter of the each of the plurality of liquid conducting holes is set to be larger than an average pore diameter of micro pores inside the body.

6. The atomizing assembly as claimed in claim 1, wherein the absorbing face is disposed corresponding to the liquid storing cavity, and the plurality of liquid conducting holes is evenly spaced and distributed on the absorbing face.

7. The atomizing assembly as claimed in claim 1, wherein the base further comprises a liquid filling hole and a liquid outlet;

the liquid filling hole is configured to spatially communicate with the liquid storing cavity, the liquid filling hole and the liquid outlet are respectively located on two opposite lateral walls of the liquid storing cavity, the liquid outlet is configured to spatially communicate with the plurality of liquid conducting holes.

8. The atomizing assembly as claimed in claim 7, wherein the atomizing assembly further comprises a supporter and an end cover;

the supporter is located at a side of the base, a fixing trough is opened and disposed at a side of the supporter facing toward the base, a part of the body is received in the fixing trough;

the end cover is disposed between the base and the supporter, another part of the body is covered around by the end cover, and the end cover is fixed connected with the supporter, the end cover is engaged with the base, and a transfer hole penetrating through the end cover is opened and disposed at the end cover, the liquid outlet is configured to spatially communicate with the plurality of liquid conducting holes via the transfer hole.

9. The atomizing assembly as claimed in claim 8, wherein a first installing trough is disposed at a side of the base facing toward the supporter, the liquid outlet is opened and disposed at a bottom of the first installing trough, the end cover is installed in the first installing trough, and the transfer hole is configured to spatially communicate with the liquid outlet.

10. The atomizing assembly as claimed in claim 9, wherein the atomizing assembly further comprises a connecting seat, the connecting seat is installed to the base, a lateral wall of the connecting seat and a lateral wall of the base are fixedly connected with each other, and an accommodating space is formed and surrounded between the connecting seat and the base, the atomizing core is accommodated in the accommodating space.

11. The atomizing assembly as claimed in claim 10, wherein a second installing trough is disposed at a side of the connecting seat facing toward the base, the supporter is installed in the second installing trough, when the connecting seat is installed to the base, the first installing trough and the second installing trough are correspondingly disposed to match with each other in order to fixedly install the atomizing core therebetween.

12. An electronic cigarette, comprising:

an atomizing assembly as claimed in claim 1;

a battery assembly is installed with the atomizing assembly and is electrically connected with the atomizing assembly.

* * * * *